United States Patent [19]

Horvath et al.

[11] Patent Number: 4,867,454

[45] Date of Patent: Sep. 19, 1989

[54] BALL GAME DEVICE

[76] Inventors: Viktor Horvath; Kordelia Horvath, both of Hallerstrasse 5b D-2000, Hamburg 13, Fed. Rep. of Germany

[21] Appl. No.: 220,218

[22] PCT Filed: Oct. 7, 1987

[86] PCT No.: PCT/EP87/00579

§ 371 Date: Aug. 18, 1988

§ 102(e) Date: Aug. 18, 1988

[87] PCT Pub. No.: WO88/02646

PCT Pub. Date: Apr. 21, 1988

[30] Foreign Application Priority Data

Oct. 18, 1986 [DE] Fed. Rep. of Germany ..... 3635501

[51] Int. Cl.[4] ..... A63D 3/02; A63B 71/00

[52] U.S. Cl. ..... 273/119 R; 273/122 R; 273/129 L; 273/85 B

[58] Field of Search ..... 273/85, 128 R, 126, 273/122 R, 110, 129 K, 129 L, 129 M, 127, 122

[56] References Cited

U.S. PATENT DOCUMENTS

| | | | |
|---|---|---|---|
| 2,710,755 | 6/1955 | Craig | 273/122 R |
| 2,967,713 | 1/1961 | Kumpman | 273/119 R |
| 3,033,570 | 5/1962 | Mathes et al. | 273/119 R |
| 3,466,042 | 9/1969 | Lucci | 273/85 A |
| 4,146,227 | 3/1979 | Kuna | 273/119 R |
| 4,286,785 | 9/1981 | Todokoro | 273/119 R |
| 4,290,606 | 9/1981 | Maxwell | 273/128 R |
| 4,501,423 | 2/1985 | Stewart | 273/122 R |

FOREIGN PATENT DOCUMENTS

| | | | |
|---|---|---|---|
| 1092822 | 10/1960 | Fed. Rep. of Germany . | |
| 2322682 | 11/1974 | Fed. Rep. of Germany . | |
| 680997 | 5/1930 | France | 273/119 R |
| 2240752 | 3/1975 | France . | |
| 176164 | 3/1922 | United Kingdom . | |

*Primary Examiner*—Edward M. Coven

*Attorney, Agent, or Firm*—Sixbey, Friedman, Leedom & Ferguson

[57] ABSTRACT

A ball game device with a striking disk. The ball is located on a table-top playing surface which slopes and is enclosed on all sides by edge members, and is made to roll by means of the striking disk and comes in contact with a further arrangement of balls, which are held in specific tracks by guide rails and can be arranged on a higher plane.

12 Claims, 2 Drawing Sheets

BALL GAME DEVICE

BACKGROUND OF THE INVENTION

The invention relates to a ball game device, in particular for sports active entertainment.

Table games with rolling balls are known in many variations. Here, three especially known embodiments are referred to: pinball, billiards and the table soccer game. In the literature there are also numerous types of games in which the balls are moved on a horizontal or slanted (table-)top with the aid of diverse, fixed or mobile objects thus, among other things, by stretched rubber bands, gutter pieces kept on an incline, elastically flexible base plates, etc.

SUMMARY OF THE INVENTION

The object of the invention is to design a ball game device so that, on the one hand, it has the wealth of combinations as they are almost exclusively characteristic of billiards and so that, on the other hand, it still imparts, even to the inexperienced player, a highly successful experience with regard to skill and chance.

The object is achieved according to the invention in that a playing ball, located on a slanted, table-like playing surface that is enclosed on all sides by angular walls, is made to start rolling by a impact disk that is freely mobile horizontally, hand-operated and designed in its shaping expressly for the purposeful striking of the playing ball and, during the free rolling around on the playing field, a second arrangement of balls, which are kept in a defined path by guide rails that are not able to be touched by the playing ball and are higher in particular, are conveyed further in this path by impact. This unites the following qualitative advantages:

sports-active, i.e., faster play communicative character, i.e., playable with several participants simultaneously, among other things competitive character, i.e., with playing opponents facing each other, diverse movement and control possibilities adjustable levels of difficulty, depending on the demand and ability of the participants self-contained system, without loose parts that are difficult to monitor operation with one hand, suitable for handicapped persons limited space required, set up in a line with access on the narrow sides.

This ball game device serves for leisure-time entertainment, with or without coin operation, as, among other things, in sport hotels, youth centers, clubs and associations and is suitable for commercial purposes in slot-machine halls as well as for the handicapped.

Other features of the invention are described in further detail in the following based on the embodiments represented in the drawings.

DETAILED DESCRIPTION OF THE PREFERRED EMBODIMENTS

Figure 2:
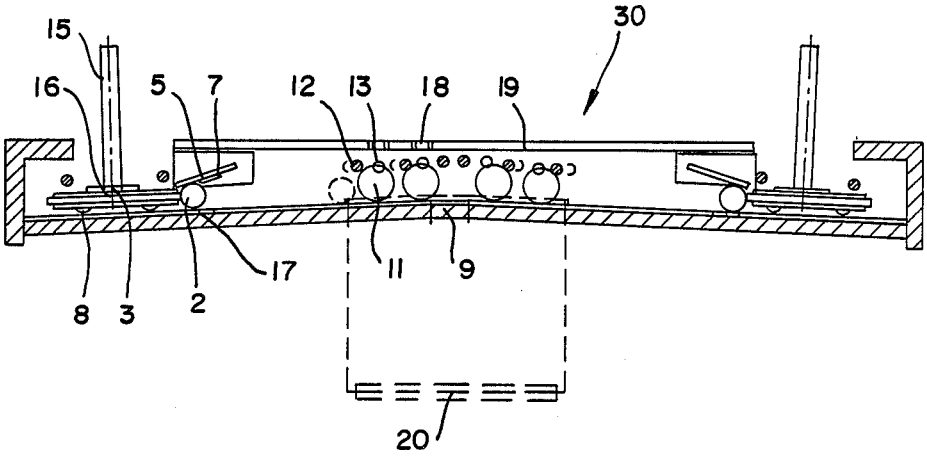
FIGS. 1 and 2 show, respectively, an embodiment of a ball game device in top view and in a view taken along line A—A of FIG. 1.
Figure 1:
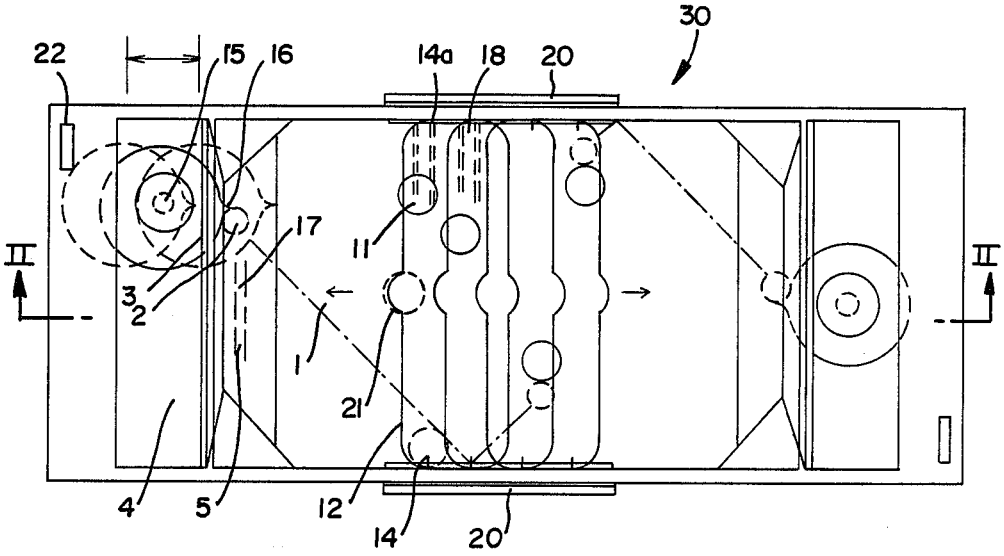

On the two narrow sides of playing field 1, there are edge zones 4 with impact disks 3. In the middle area of playing field 1, four fixed balls 11 are placed that are supported for movement along individual, transverse paths.

The paths are formed by guide rails 12, which run at a height above the bottom surface, such that playing balls 2 can roll around under them unimpeded, but not fixed balls 11, which are suitably larger in diameter.

The playing surface slopes toward both edge zones 4, a transition area 9 is formed in the middle, in a gradual arc, so that playing balls 11 do not lift up off the bottom surface.

The dimensions of edge zone 4 allow the player to move impact disk 3 with momentum, but without lifting it out of enclosure 5. The form of impact disk 3 in turn makes it possible to strike playing ball 2 purposefully, namely depending on the respective position in each case of fixed ball 11 and playing ball 2.

At the beginning of the game, fixed balls 11 are brought into the middle, this purpose is served by slots 18, which are incorporated into safety glass cover plate 19. But pushing of fixed balls 11 into the middle is also possible in a mechanical motorized way, e.g., by two sliding bars 20 which, in the rest position, are on the two external sides and bring fixed balls 11 into the middle position by a cable embedded in the middle line of the playing surface. Since guide rails 12 have a slight bulge 21 in the middle in the direction of the bottom slope, fixed balls 11 come to rest in this position.

Hit sensors 13 are located at the path ends. If they are arranged so that a full side, generally left from the player's viewpoint, is allocated to each edge zone 4, then the player will try to hit fixed balls 11 with playing ball 2 always on the correct side and to drive them by spinning them toward the outer wall. Guide rails 12 allow fixed ball 11 the amount of clearance necessary for accommodating the spin.

Directly in front of the outer wall with hit sensors 13, guide rails 12 run in the direction opposite to the bottom slope. Thus, a fixed ball 11 can touch the sensor surface only briefly under the impact effect, then it rolls back into playing surface 1. Hits are registered by LED displays 22.

If it is desired to raise the degree of difficulty, then two of four fixed balls 11 are taken out of the game. By changing the switching system of the hit sensors, still more skill can be demanded of the players if, for example, each of them has, in each case, alternately two sensors on the left and right outer side as the target.

If it is desired to simplify the game, for example for children, then all fixed balls 11 can be removed from the game. The surface under enclosures 5 then acts as a ball goal and the players will try, by quick reaction with impact disk 3, to keep playing ball 2 away from it. Detection of the hits here can also occur electronically, e.g., by hit sensors that are in a position protected from impact disk 3 or by conductive paths 17 which are embedded in the playing surface and which definitely react to metal playing ball 2, but not to plastic castors 8 of impact disk 3.

Figure 4:
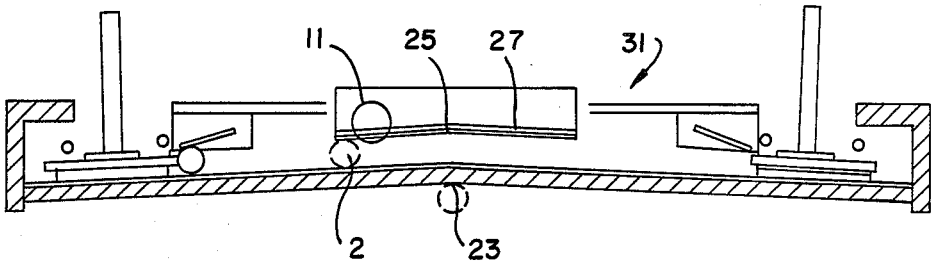
FIGS. 3 and 4 show, respectively, another embodiment of a ball game device in top view and in a view taken along line B—B of FIG. 3.
Figure 3:
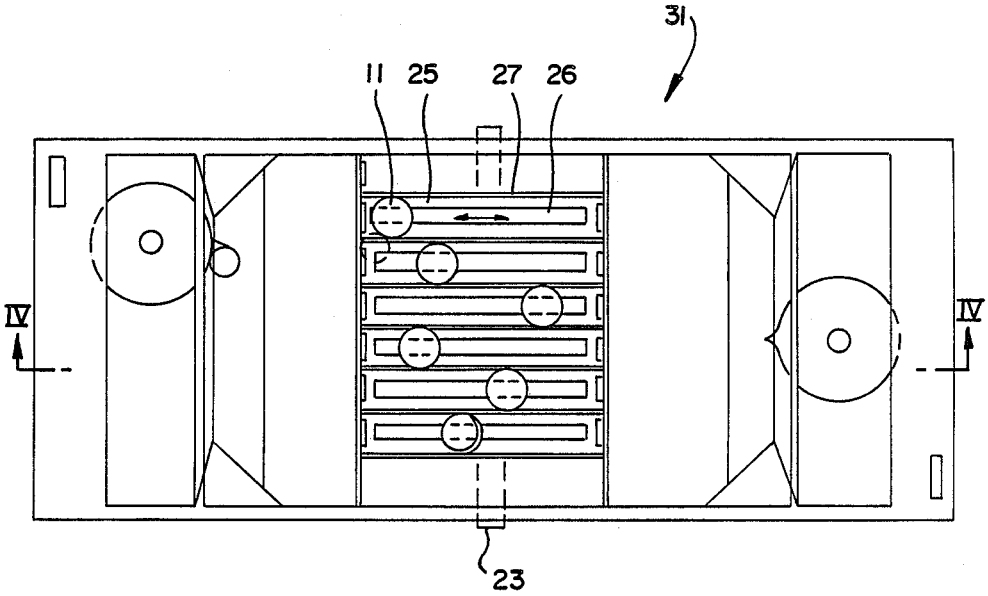

FIGS. 3 and 4 represent a ball game device 31 in which the second system of balls 11 is on a raised plane 25 and only the lower part of the balls projects into an overhead area in which they may be contacted by playing ball 2. For this reason raised plane 25 is provided with slot-shaped recesses 26. If playing ball 2 hits this part of overhead balls 11, the latter roll further in the path determined by the slots.

The directions of movement are opposite. Both players on the ends of the table can generally impart only thrust to balls 11. If the ends of the path are set as the targets, which are possibly equipped with electronic counting devices, then an orderly course of the game can occur.

A particular advantage of this arrangement is that on second, raised plane 25, a game status that is readable even without electronic counting devices can be recorded at any time. Starting from a position of ball 11 on the middle line, the side that has a majority of balls roll into the opposing half of the playing field on raised plane 25 will win the game.

The impact effect between playing balls 2 rolling below and balls 11 above can also be increased by mechanical devices (spring plates, small edges).

In both ball game devices 30, 31 the entire playing surface is enclosed by angular walls, which is to prevent balls 2, 11 and impact disk 3 from rolling away. At the same time, the playing surface is divided into at least two and, preferably, three zones, a larger playing field portion of playing surface 1 and one or several edge zones 4.

The balls located on playing surface 1 determine the course of the game. As a rule there are two kinds of these:

Playing ball 2 is made to start rolling by moving hand-operated impact disk 3 along edge zone 4. The ball 2 crosses playing surface 1, in doing so can hit the lateral enclosure walls, and other playing balls 2 located on playing surface 1 and fixed balls 11. Furthermore, since playing surface 1 slopes downwardly to edge zones 4 the ball lands again along edge zone(s) 4.

Fixed ball 11 is larger in diameter than playing ball 2. As a result, its path can be determined by guide rails 12, which are above the total height of playing ball 2, but still below the total height of fixed ball 11; they run approximately at a right angle to the main impact direction of impact disk 3 and thus, simultaneously, at a right angle to the slope of playing surface 1. Fixed balls 11 are located between individual guide rails 12 and are thus, differing from playing balls 2, hardly affected in their movement by the slope. A movement of fixed balls 11 in the direction of the slope occurs only if upper guide rails 12 also exhibit a corresponding directional component. The same occurs in the middle of the surface, where an initial movement of fixed balls 1 is to be achieved with this, or at ends 14, 14*a* of guide rails 12, by which a necessary repeated moving away of fixed balls 11 from the lateral enclosure bands is intended.

Playing ball 2 indirectly starts fixed balls 11 rolling. If playing ball 2 coming from impact disk 3 or bouncing off the lateral enclosure bands hits a fixed ball 11, then the latter will generally roll further along guide rail 12 (spin). For this purpose there is a clearance between guide rails 12. Corresponding to the slope, the fixed ball always remains on guide rail 12 that lies toward edge zone 4.

At the beginning of the game, fixed balls 11 are in central bulge 21 of guide rails 12. After the players, who usually stand opposite each other and play simultaneously, have started fixed balls 11 rolling with generally two playing balls 2 by impact disk 3, fixed balls 11 move away from the central position toward the lateral enclosure walls. If they then reach the enclosure wall they activate, at the same time, hit sensors 13 to detect the hit, e.g., in the form of a sensor plate that transmits a pulse to an LED display. Hit sensors 13 are also placed above the overall height of playing balls 2. A mistaken display is thus impossible. Only the pulses triggered by fixed balls 11 are registered. The degree of difficulty of the game can be influenced considerably by changing the number of fixed balls 11 and by changing the sequence of hit sensors 13 arranged laterally:

with a considerable number of fixed balls 11, hits by random effect are easier to achieve than when only one or two fixed balls 11 are set up.

with a grouping of devices 13 to detect hits left and right on the two outer sides, hits are easier to achieve than when opponents' hits (alternately) are registered only inside one outer side.

The changes described in the degree of difficulty can be achieved with a minimum expense, e.g., by varying switching systems of hit sensors 13.

Between the player and playing surface 1, there is above-mentioned edge zone 4 together with impact disk 3. Impact disk 3 is preferably a plate-shaped rolling body that exhibits a handle 15 on the top, a projecting impact ring 16 on the side and generally three castors 8 on the bottom. Impact disk 3 is moved freely inside edge zone 4 by hand. Vertical mobility can be limited to prevent uncontrolled lifting out. For this purpose, the clearance distance of the fixed longitudinal side parts of edge zone 4 above impact ring 16 is reduced to the extent that a lifting out is no longer possible. For example, as can be seen from the drawings, each impact device is confined to a movement area from which it is prevented from being directly removed by a clearance distance, extending longitudinally between a lip portion of the angular walls and the respective enclosure 4, being smaller than horizontally extending dimensions of said impact member.

Playing ball 2, coming from playing surface 1, runs tightly under wedge-shaped enclosure 5, which is formed with or without elastic padding 7, between playing surface 1 and edge zone 4. After the player has surveyed the mutual position of fixed ball 11 and playing ball 2, he tries, with the optimal point of impact disk 3, to hit playing ball 2 at an optimal angle.

If the play is without fixed balls 11 on playing surface 1, the partial surface under enclosure 5 between playing surface 1 and edge zone 4 can act as the ball goal. If the player does not succeed in keeping the playing ball away, it is judged as a hit. Detection of the hit can be triggered mechanically or electronically, e.g., by sensors that react to playing ball 2 but not to impact disk 3, or by a conductive bottom 17 that reacts to a metal playing ball 2 but not to plastic castors 8 of impact disk 3.

To keep the unit under control, playing field 1 can be covered with a glass plate. If fixed balls 11 are brought mechanically into the starting position, slots 18 are incorporated into glass plate 19.

We claim:

1. Ball game device with a sloping playing surface that is enclosed on all sides by angular walls, at least one playing ball, an arrangement of additional balls, a plurality of guide rails forming a means for confining said additional balls to defined paths of movement over said playing surface, and a manually operated impact device placed on each of opposite end sections of said playing surface, the impact device being a horizontally freely mobile impact disk forming a means for causing said at least one playing ball to roll along said playing surface into engagement with said arrangement of additional balls, wherein said guide rails are disposed at a height above said playing surface that is greater than the diameter of said playing ball and, at each end section of said playing surface, an enclosure means is placed for defining a respective end of a playing field portion of said playing surface over which said playing ball can roll and below which a ball contacting section of said impact disk can pass onto the playing field portion for impacting the playing ball.

2. Ball game device according to claim 1, wherein the additional balls have a diameter that is greater than the diameter of said at least one playing ball.

3. Ball game device according to claim 1, wherein an underside of said enclosure means slants downwardly in a direction from center of said playing field portion toward the respective said end section.

4. Ball game device according to claim 1, wherein said impact disk is supported on casters.

5. Ball game device according to claim 1, wherein each impact device is confined to a movement area from which it is prevented from being directly removed by a clearance distance, extending longitudinally between a lip portion of the angular walls and the respective enclosure means, being smaller than horizontally extending dimensions of said impact member.

6. Ball game device according to claim 1, wherein said guide rails run approximately at a right angle to the slope of said playing surface.

7. Ball game device according to claim 1, wherein said guide rails run approximately parallel to the slope of said playing surface.

8. Ball game device according to claim 1, wherein said enclosure means runs at an angle to the slope of the playing surface at outer corner areas of said playing field portion of the playing surface.

9. Ball game device according to claim 1, wherein a middle section of said playing surface has an arched surface piece from which the playing surface slopes downwardly to said end sections.

10. Ball game device according to claim 1, wherein said playing surface is tiltably mounted on an axial bracket that extends across its center.

11. Ball game device according to claim 1, wherein said guide rails support said additional balls elevated above said playing surface in a manner wherein only a respective lower part of said additional balls protrudes through slot-shaped recesses formed by said guide rails into an overhead area in which the playing balls can be brought in contact with the additional balls.

12. Ball game device according to claim 11, wherein said guide rails run approximately parallel to the slope of said playing surface.

* * * * *